US006471076B1

(12) United States Patent
Chen

(10) Patent No.: US 6,471,076 B1
(45) Date of Patent: Oct. 29, 2002

(54) REVOLVING RACK FOR HOLDING OR DISPLAYING PISTOL NOZZLES

(75) Inventor: Chin-Yuan Chen, Chang-Hua Hsien (TW)

(73) Assignee: Shin Tai Spurt Water of the Garden Tools Co., Ltd., Chang-Hua Hsien (TW)

( * ) Notice: Subject to any disclaimer, the term of this patent is extended or adjusted under 35 U.S.C. 154(b) by 0 days.

(21) Appl. No.: 09/938,241

(22) Filed: Aug. 24, 2001

(51) Int. Cl.[7] ..... A47F 7/00

(52) U.S. Cl. ..... 211/70.6; 211/70; 211/205; 248/415

(58) Field of Search ..... 211/70, 163, 205, 211/70.6, 70.8, 60.1; 248/415, 158

(56) References Cited

U.S. PATENT DOCUMENTS 160,339 A * 3/1875 Ladd ..... 211/62
1,148,895 A * 8/1915 Gehl ..... 211/60.1
1,586,826 A * 6/1926 Michelbach ..... 211/163
1,586,827 A * 6/1926 Michelbach ..... 211/70
3,524,554 A * 8/1970 Ruhnke ..... 211/163
3,661,270 A * 5/1972 Lucci et al. ..... 211/205
4,756,429 A * 7/1988 Lehman et al. ..... 211/163
5,249,856 A * 10/1993 Dreier ..... 211/163
5,676,261 A * 10/1997 Baughman et al. ..... 211/163
5,746,334 A * 5/1998 Brandenberg ..... 211/205

* cited by examiner

*Primary Examiner*—Blair M. Johnson
*Assistant Examiner*—Khoa Tran
(74) *Attorney, Agent, or Firm*—Harrison & Egbert

(57) ABSTRACT

A rack is designed to hold a plurality of pistol nozzles and is formed of a base and a displaying frame. The base is rested on the floor surface and is provided with a support rod on which the displaying frame is supported such that the displaying frame can be revolved and adjusted in height.

1 Claim, 8 Drawing Sheets

REVOLVING RACK FOR HOLDING OR DISPLAYING PISTOL NOZZLES

BACKGROUND OF THE INVENTION

1. Field of the Invention

The present invention relates generally to a sprinkler accessory, and more particularly to a revolving rack for holding or displaying a plurality of pistol nozzles.

2. Description of Related Art

Conventional spray nozzle racks have a fixed frame which can neither be adjusted nor revolved, thereby resulting in a great deal of inconvenience to the user of the rack. In light of the conventional rack frames being fixed, the conventional spray nozzle racks are not adapted to hold or display spray nozzles of various forms or lengths. In addition, the conventional spray nozzle racks cannot rotate to facilitate the selecting of a desired spray nozzle by the user.

BRIEF SUMMARY OF THE INVENTION

The primary objective of the present invention is to provide a spray nozzle rack which is free of the drawbacks of the conventional spray nozzle racks described above.

The foregoing objective of the present invention is achieved by a revolving rack comprising a base and a displaying frame which is rotatably mounted on the base and is adjustable in height. The base is provided with a means to locate the handles of the pistol nozzles which are held by the displaying frame.

The features and the advantages of the present invention will be more readily understood upon a thoughtful deliberation of the following detailed description of the preferred embodiments of the present invention with reference to the accompanying drawings.

DETAILED DESCRIPTION OF THE INVENTION

Figure 1:
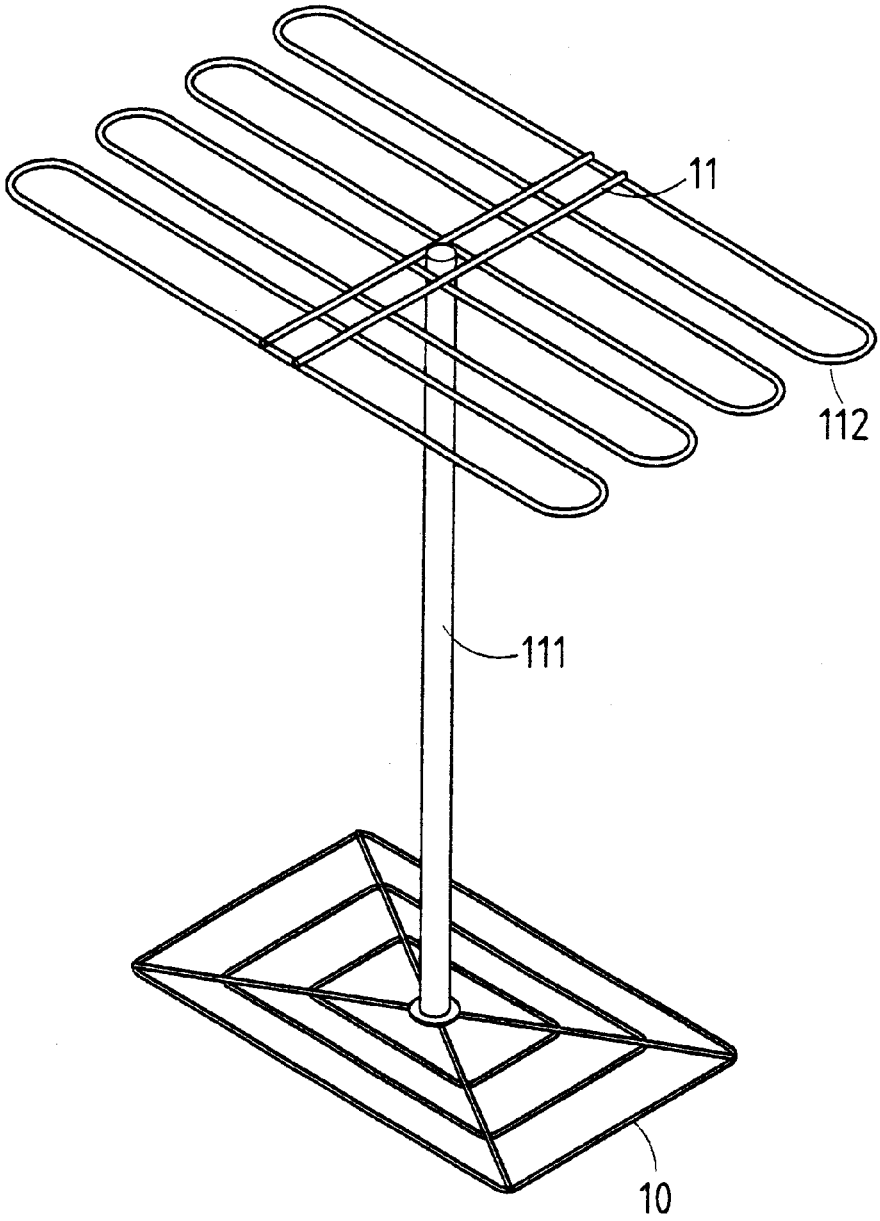
FIG. 1 shows a perspective view of a first preferred embodiment of the present invention.
Figure 2:
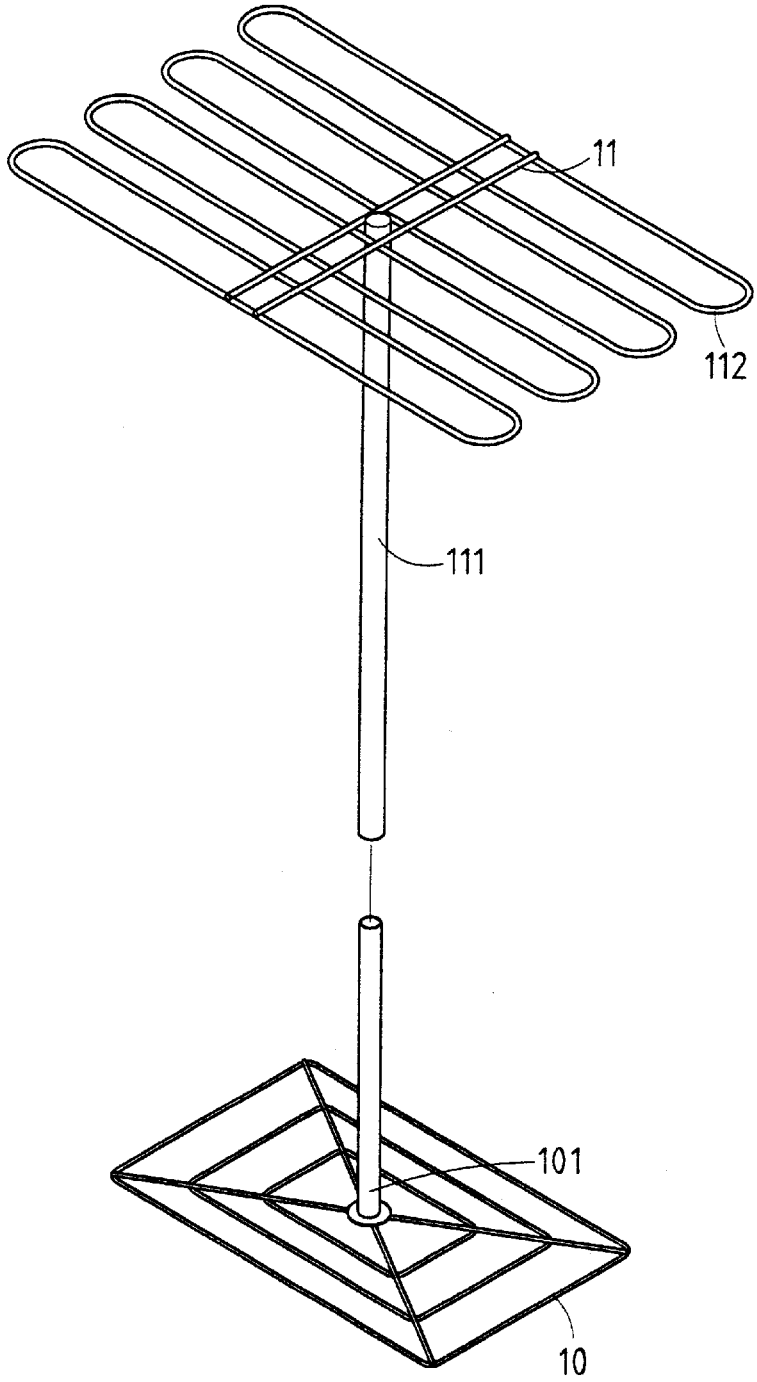
FIG. 2 shows an exploded view of the first preferred embodiment of the present invention.
Figure 3:
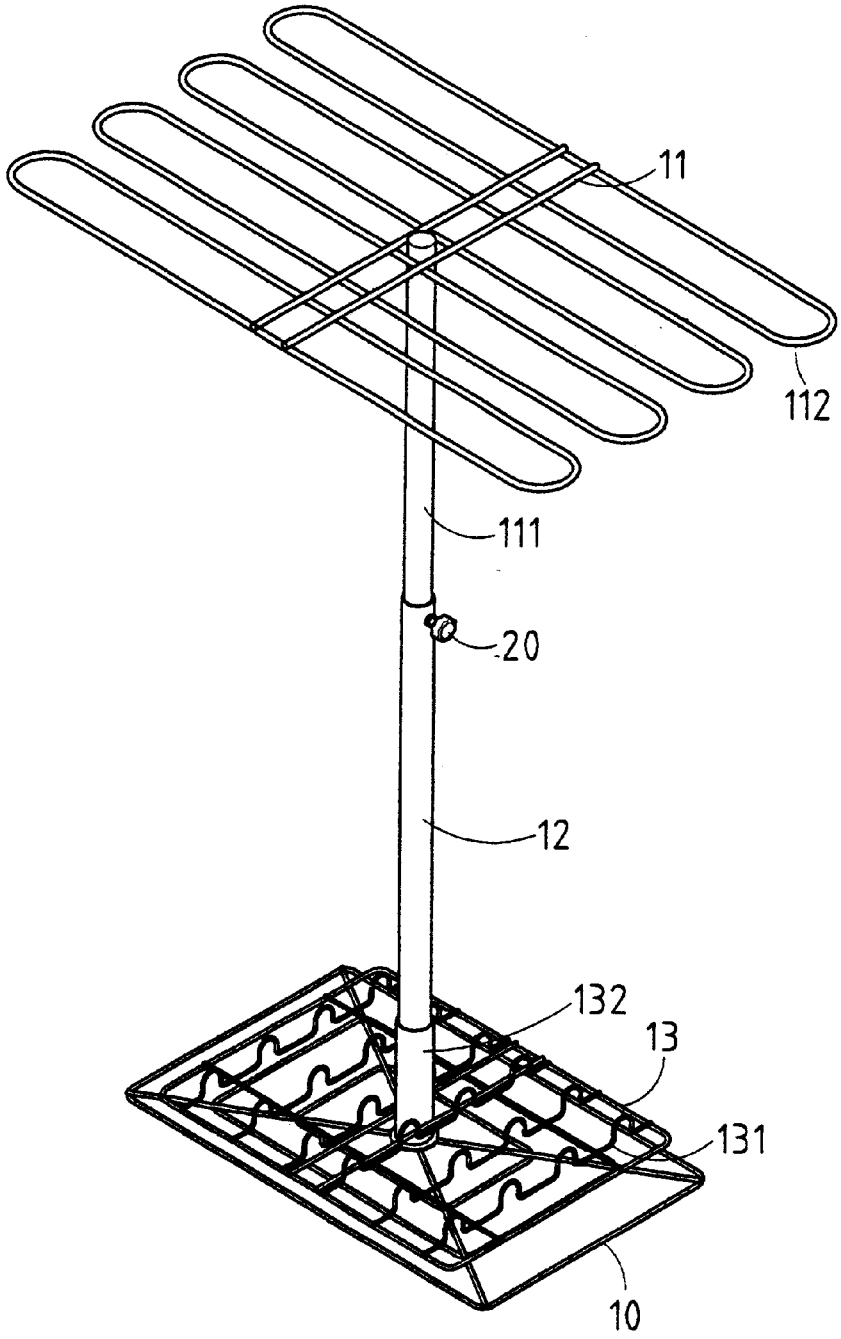
FIG. 3 shows a perspective view of a second preferred embodiment of the present invention.
Figure 4:
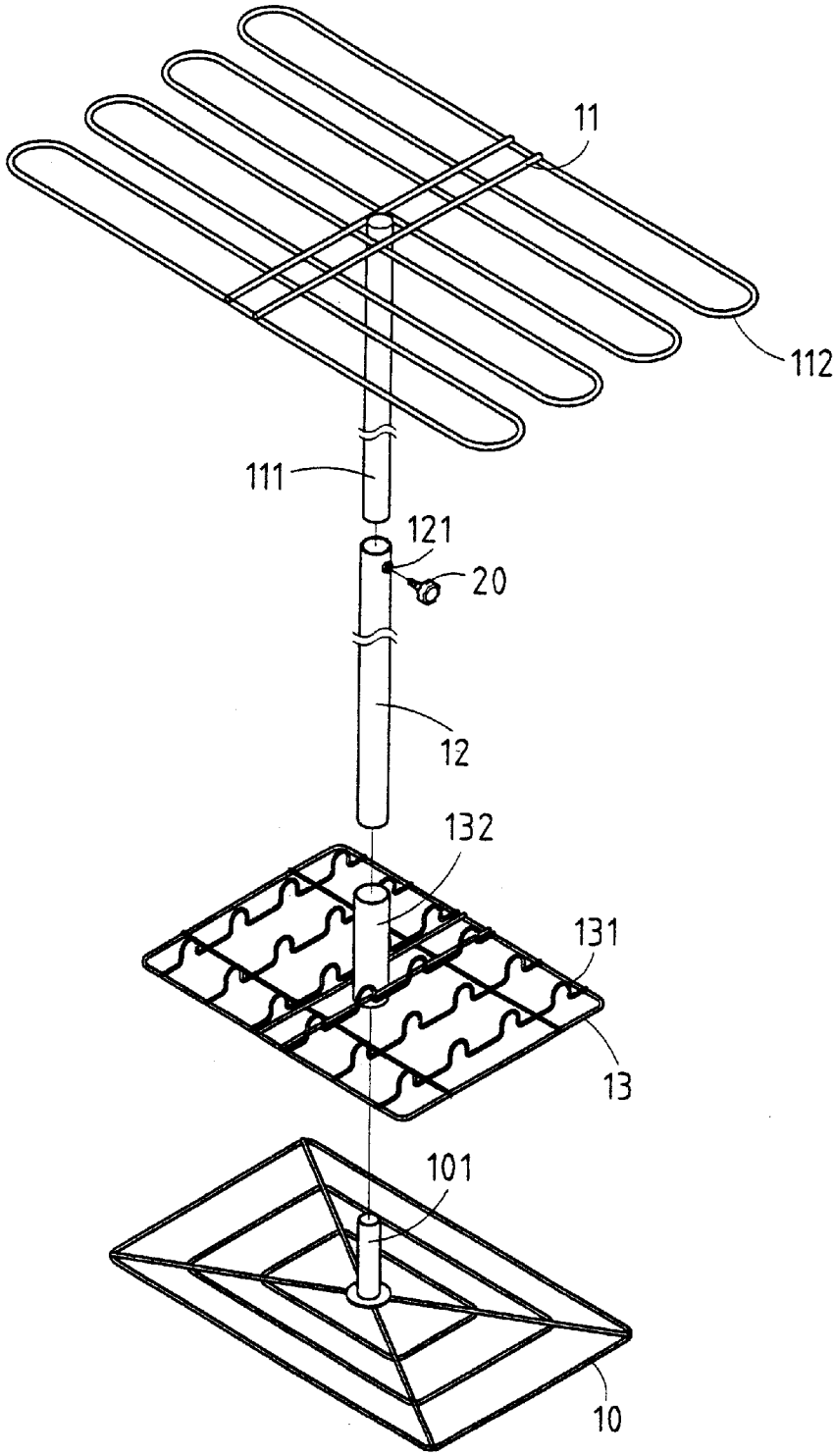
FIG. 4 shows an exploded view of the second preferred embodiment of the present invention.

As shown in FIGS. 1–2, a pistol nozzle rack of the first preferred embodiment of the present invention comprises a base 10 and a displaying frame 11.

The base 10 is rested on the floor and is provided in the center of the upper side thereof with an upright support rod 101 for supporting the displaying frame 11.

The displaying frame 11 is formed of a hollow support tube 111 and a plurality of nozzle holders 112. The hollow support tube 111 is rotatably fitted over the upright support rod 101 of the base 10. The nozzle holders 112 are supported by the top end of the hollow support tube 111. The nozzle holders 112 are capable of holding a plurality of pistol nozzles of various forms and lengths.

The displaying frame 11 can be revolved such that the hollow support tube 111 turns on the upright support rod 101 of the base 10. The pistol nozzle rack of the first preferred embodiment of the present invention is simple in construction and cost-effective.

As shown in FIGS. 3–8, a pistol nozzle rack of the second preferred embodiment of the present invention comprises a base 10, a locating piece 13, a revolving hollow tube 12, and a displaying frame 11.

The base 10 is rested on a surface and is provided at the center of the upper side thereof with an upright support rod 101.

The locating piece 13 is corresponding in shape and size to the base 10 and is provided at the center of the upper side thereof with a hollow support tube 132 which is dimensioned to fit over the upright support rod 101 of the base 10 such that there is an appropriate gap between the inner wall of the hollow support tube 132 and the outer wall of the upright support rod 101 of the base 10. The locating piece 13 is further provided in the upper side with a plurality of locating projections 131 which are arranged at intervals for locating the bottom ends of the handles of the pistol nozzles.

Figure 5:
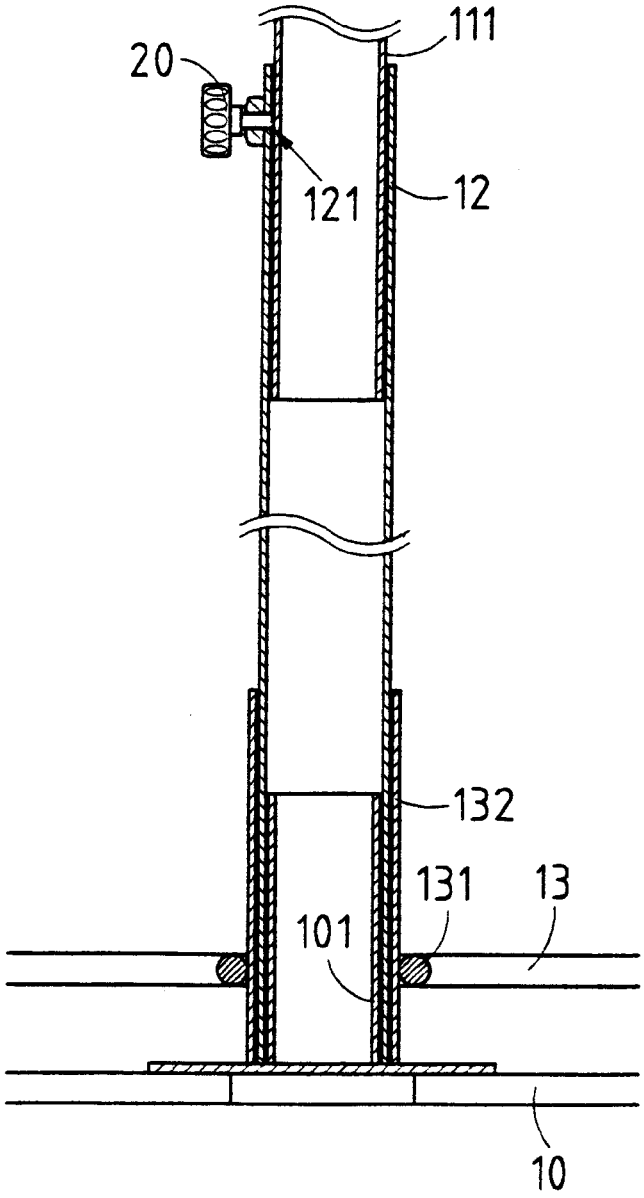
FIG. 5 shows a partial longitudinal sectional view of the second preferred embodiment of the present invention.
Figure 6:
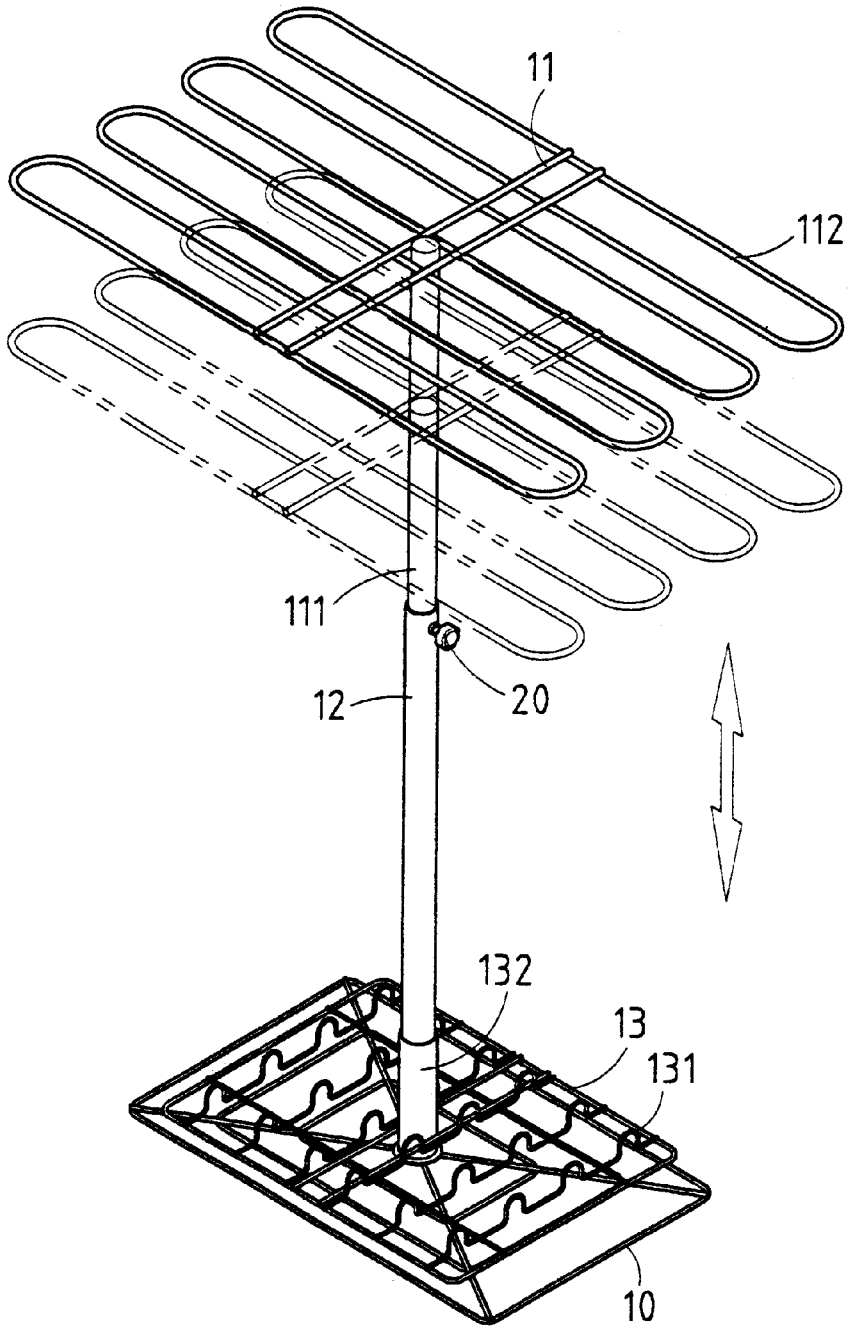
FIG. 6 shows a schematic view of the second preferred embodiment of the present invention being adjusted in height.
Figure 7:
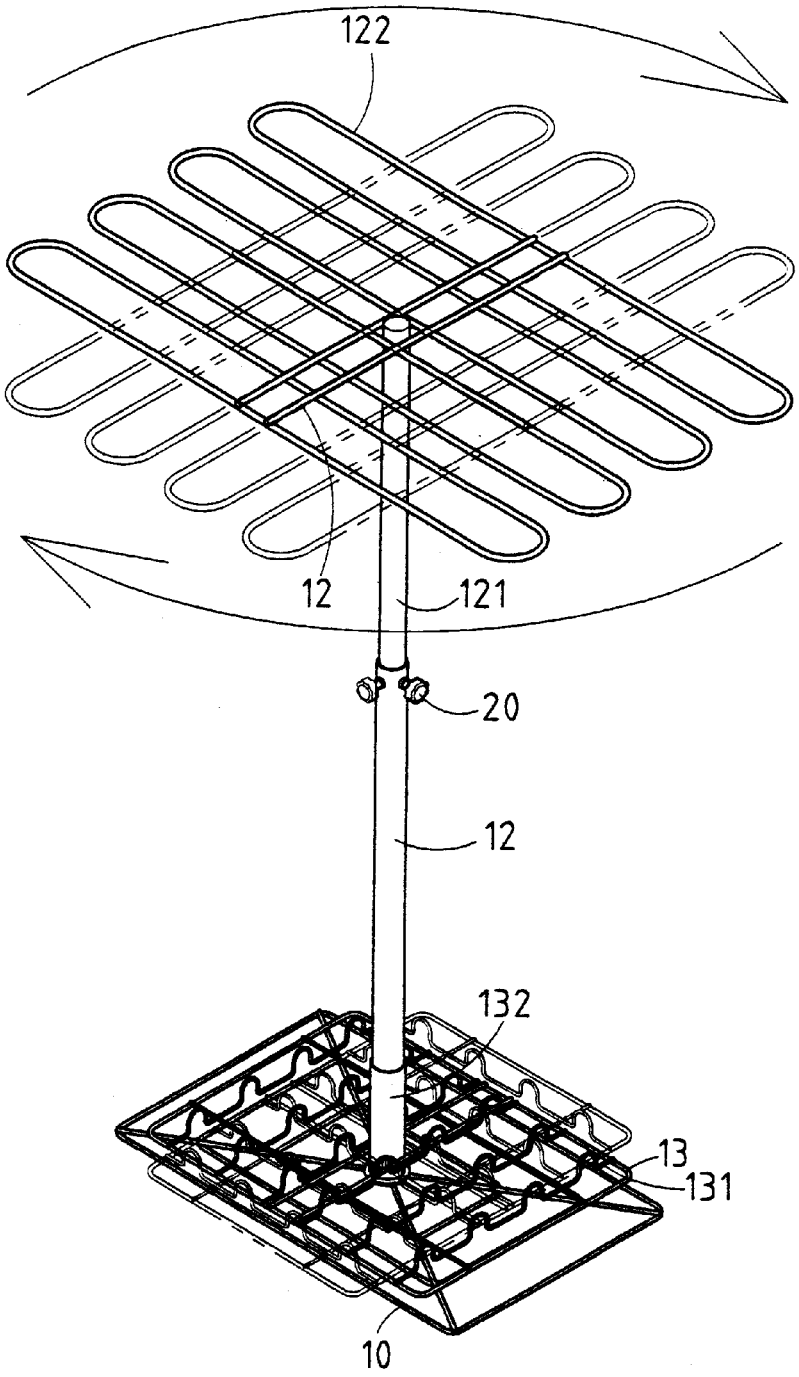
FIG. 7 shows a schematic view of the second preferred embodiment of the present invention being rotated.
Figure 8:
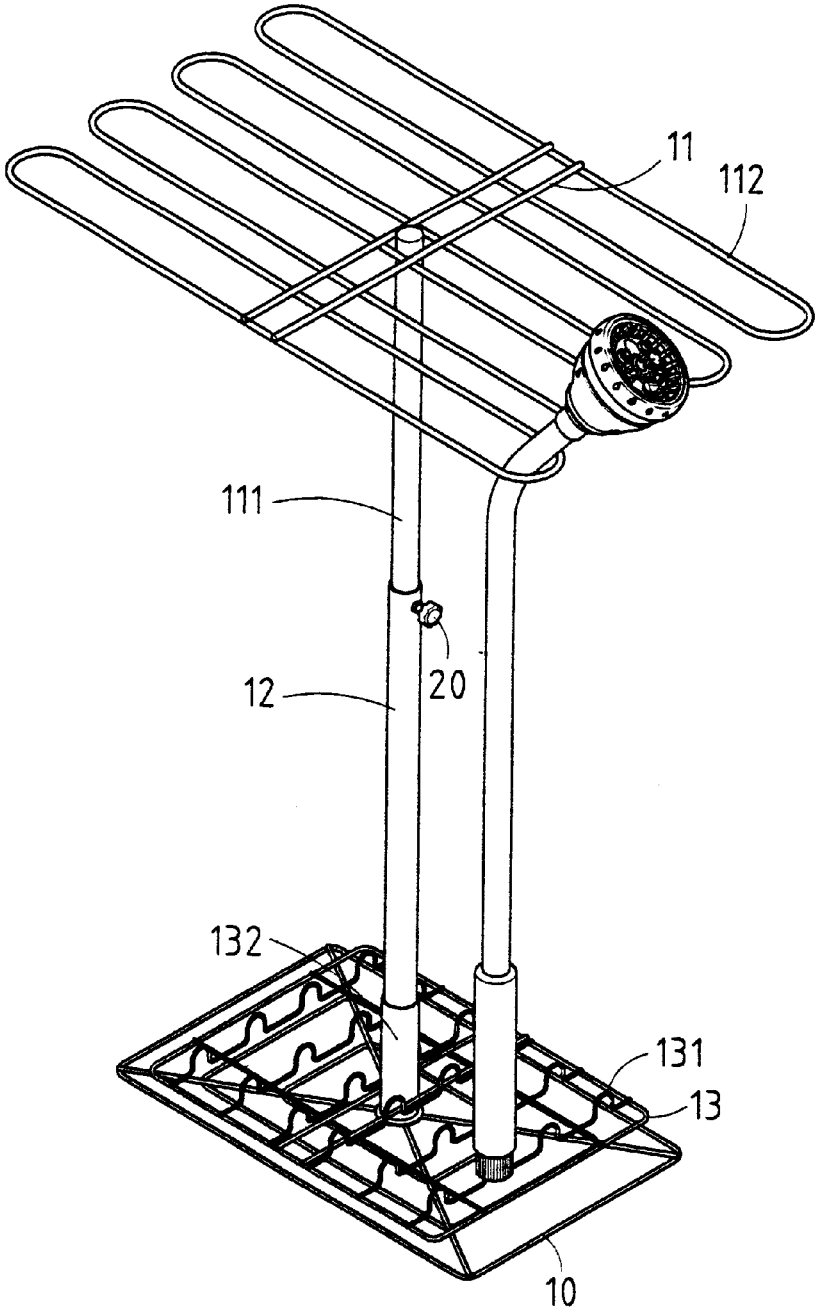
FIG. 8 shows a schematic view of the second preferred embodiment of the present invention at work.

The revolving hollow tube 12 is so dimensioned to fit into the hollow support tube 132 such that the revolving hollow tube 12 is fitted over the upright support rod 101 of the base 10, as shown in FIG. 5. In other words, the revolving hollow tube 12 has a lower segment which is rotatably received in the gap between the outer wall of the upright support rod 101 and the inner wall of the hollow support tube 132 of the locating piece 13. The revolving hollow tube 12 is provided at the top end with a threaded through hole 121 and a locating bolt 20 which is engaged with the threaded hole 121 to locate the displaying frame 11 at an appropriate height.

The displaying frame 11 is formed of a post 111 and a plurality of nozzle holders 112 which are supported by the top end of the post 111. The bottom end of the post 111 is slidably fitted into the top end of the revolving hollow tube 12 such that the bottom end of the post 111 is positioned by the locating bolt 20 in conjunction with the threaded hole 121 of the revolving hollow tube 12.

In light of the revolving hollow tube 12 being rotatable on the upright support rod 101 of the base 10, the displaying frame 11 can be revolved to facilitate the selecting of the pistol nozzles held by the nozzle holders 112 of the displaying frame 11. In addition, the displaying frame 111 can be adjusted in height by means of the post 111 which can be slid in the revolving hollow tube 12.

The embodiments of the present invention described above are to be regarded in all respects as being merely illustrative and not restrictive. Accordingly, the present invention may be embodied in other specific forms without deviating from the spirit thereof. The present invention is therefore to be limited only by the scope of the following claims.

I claim:

1. A rack for displaying a plurality of pistol nozzles comprising:

a base rested on a surface and provided at the center of an upper side thereof with an upright support rod;

a locating piece provided at the center of an upper side thereof with a hollow support tube which is fitted over said upright support rod of said base such that there is a gap between an inner wall of said hollow support tube and an outer wall of said upright support rod of said base, said locating piece being further provided in the upper side with a plurality of locating projections which are arranged at intervals for locating bottom ends of handles of the pistol nozzles;

a revolving hollow tube fitted into said hollow support tube of said locating piece such that a lower segment of said revolving hollow tube is rotatably received in said gap between the outer wall of said upright support rod of said base and the inner wall of said hollow support tube of said locating piece whereby said revolving hollow tube is provided at a top end with a threaded through hole and a locating bolt which is engaged with said threaded through hole; and a displaying frame comprised of a post and a plurality of nozzle holders which are supported by a top end of said post whereby said post is slidably fitted at a bottom end thereof into the top end of said revolving hollow tube such that said post is securely located by said locating bolt of said revolving hollow tube.

* * * * *